US005507479A

United States Patent [19]

Martin et al.

[11] Patent Number: 5,507,479

[45] Date of Patent: Apr. 16, 1996

[54] FLAT OBJECT TRANSFER DEVICE, AND UNSTACKING DEVICE EQUIPPED WITH THIS TRANSFER DEVICE

[75] Inventors: Philippe Martin, Valence; Jean-Marc Teluob, Guilherand; Jean-Luc Astier, La Roche De Glun, all of France

[73] Assignee: Compagnie Generale D'Automatisme CGA-HBS, Bretigny Sur Orge, France

[21] Appl. No.: 309,150

[22] Filed: Sep. 20, 1994

[30] Foreign Application Priority Data

Sep. 27, 1993 [FR] France ..... 93 11456

[51] Int. Cl.[6] ..... B65H 5/08

[52] U.S. Cl. ..... 271/11; 271/12; 271/94; 271/104; 271/31.1; 271/273; 271/266

[58] Field of Search ..... 271/3.12, 11, 12, 271/10.03, 94, 96, 104, 31.1, 266, 272, 273, 274, 276

[56] References Cited

U.S. PATENT DOCUMENTS

| | | | |
|---|---|---|---|
| 4,364,554 | 12/1982 | Akers . | |
| 4,502,804 | 3/1985 | Willcox | 271/272 |
| 4,893,804 | 1/1990 | Sasage et al. | 271/11 |
| 4,909,499 | 3/1990 | O'Brien | 271/273 |
| 5,129,641 | 7/1992 | Long | 271/10.03 |
| 5,290,022 | 3/1994 | Sabatier et al. . | |

FOREIGN PATENT DOCUMENTS

| | | |
|---|---|---|
| 0429118A1 | 5/1991 | European Pat. Off. . |
| 1349035 | 4/1962 | France . |
| 2379459 | 9/1978 | France . |
| 2679539 | 1/1993 | France . |

OTHER PUBLICATIONS

French Search Report FR 9311456.

*Primary Examiner*—H. Grant Skaggs
*Attorney, Agent, or Firm*—Sughrue, Mion, Zinn, Macpeak & Seas

[57] ABSTRACT

A flat object transfer device for transferring flat objects, particularly flat objects of varying thickness, to a sorting device from the output of an unstacking device. The flat object transfer device includes a gripping device for gripping a flat object initially located in a transfer plane. The gripping device includes a set of pinch rollers and pulleywheels on opposite sides of each pinch roller. A set of drive belts are trained around each pinch roller and the pulleywheels on opposite sides of the pinch roller. At least one of the pinch rollers in the set of pinch rollers can move in a direction substantially perpendicular to the transfer plane. A double pick separator device is provided for retaining flat objects except for a flat object to be gripped by the gripping device. The double pick separator device is disposed between two levels of the drive belts trained around the pinch rollers and pulleywheels. The gripping device can be controlled by a control device so as to immobilize the flat object pending authorization for its transfer to the sorting device.

9 Claims, 1 Drawing Sheet

FIG_1
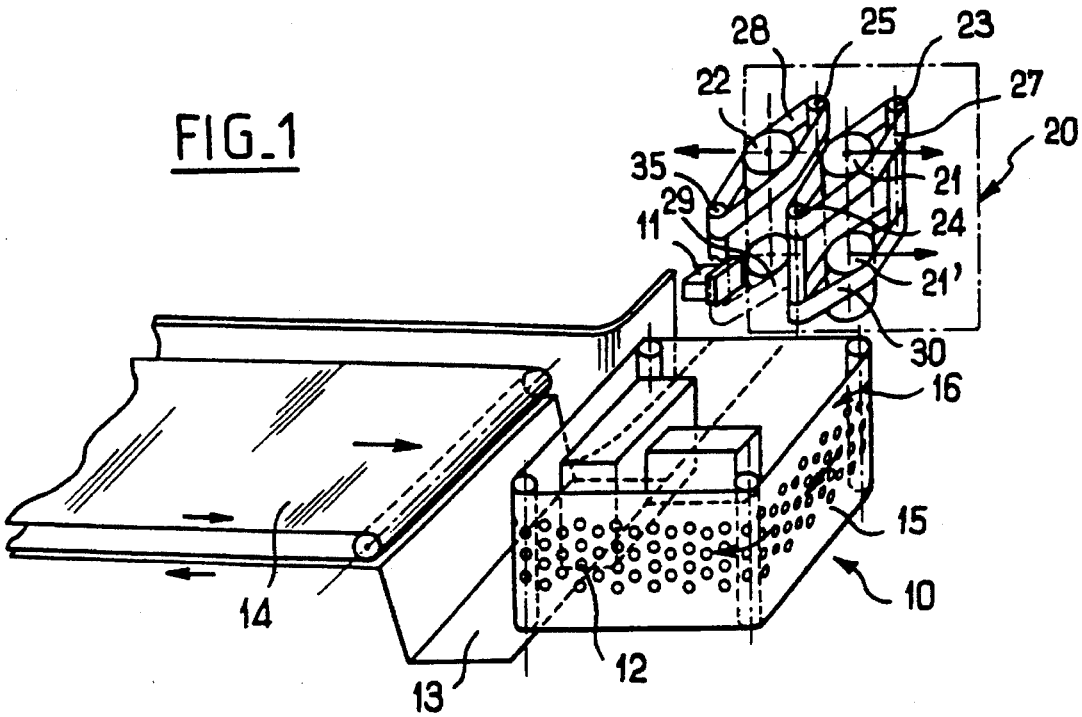
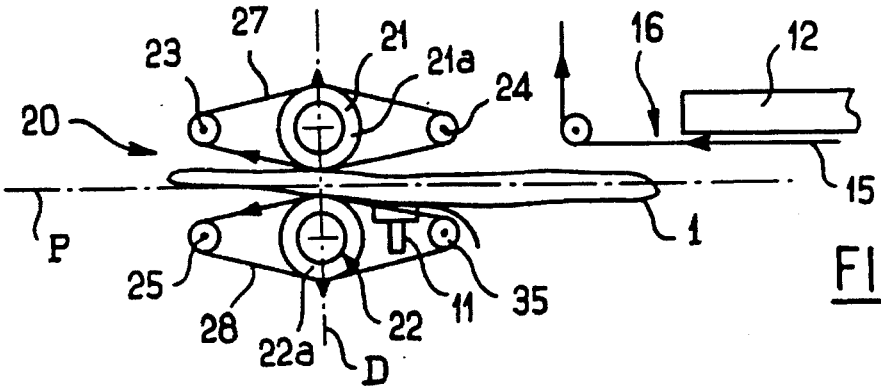
FIG_2
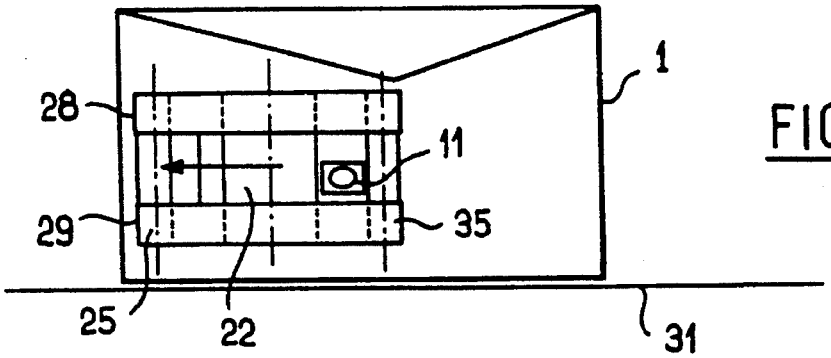
FIG_3

FLAT OBJECT TRANSFER DEVICE, AND UNSTACKING DEVICE EQUIPPED WITH THIS TRANSFER DEVICE

The present invention concerns a flat object transfer device. It is also directed to a flat object unstacking device equipped with this transfer device.

BACKGROUND OF THE INVENTION

A flat object unstacking device comprises four main units:

a mail feed magazine, a mail holding device, a double pick separator, a transfer or take-off device.

The mail is stood on edge on a belt with its back against a plate. The belt and the plate are driven simultaneously so that the mail is moved towards the holding device. The belt leads to a sudden change in level, referred to hereinafter as the drop, near the mail holding device. The feed magazine is between the drop and the holding device and is adapted to receive the mail items or flat objects pending unstacking. The holding device has suction areas across which a perforated belt passes.

On leaving the holding device the mail passes in front of the suction area of the double pick separator on the opposite side of the belt. This unit retains mail items that might otherwise be entrained by friction by the preceding mail item so that only one mail item at a time can leave.

On leaving the double pick separator the mail is taken into a transfer device which constitutes an interface between the unstacking device and a sorting device.

Large mail items are sorted by placing them in buckets, so unstacking must be on demand rather than continuous.

It is also necessary to stop the mail almost immediately when it enters the transfer device. The conventional means of achieving this halt the mail very unevenly because of substantial bouncing of thick mail items leading to loss of contact with the mail item at the point where it should be halted.

French patent application No 91 09431 of 25 Jul. 1991 in the name of this Applicant discloses a device for unstacking mail items having at its output mail item transfer means comprising two associated belts with a gripping action. These means cannot transfer objects of varying thickness, however, and operate continuously.

OBJECTS AND SUMMARY OF THE INVENTION

An object of the invention is to propose a transfer device able to halt a flat object of "any" thickness and especially a large object at the output from an unstacking device and to deliver this flat object on demand to a sorting device, the disposition of the transfer device contributing to minimizing uneven halting of the flat objects inside the sorting device.

The invention proposes a device for transferring flat objects to sorting means from the output of a device for unstacking flat objects, comprising means for gripping a flat object initially located in a transfer plane, said means being adapted to move in a direction substantially perpendicular to the first plane, and wherein said gripping means are controlled in such a way as to immobilize said flat object pending authorization for its transfer to the sorting means.

It is therefore possible to halt objects of varying thickness and to transfer them to a sorting device designed to process the objects one at a time.

In a preferred embodiment of the invention the gripping means comprise two pinch rollers having a soft material on their outside and at least one of which is mobile in a displacement plane perpendicular to said transfer plane and, for each roller, a set of drive belts tensioned around said roller and at least one pulleywheel on opposite sides of said roller.

In another aspect of the flat object unstacking device of the invention comprising flat object feed means, holding means, double pick separator means and a flat object transfer device in accordance with the invention, the flat object transfer device comprises means for gripping a flat object previously driven by the holding means, said gripping means being controlled in such a way that said flat object is transferred by said transfer device after a transfer authorization is received.

BRIEF DESCRIPTION OF THE DRAWINGS

Other features and advantages of the invention emerge in the following description. In the appended drawings given by way of non-limiting example:

FIG. 1 is an overall view of a flat object unstacking device of the invention;

FIG. 2 is a top view of a flat object transfer device or take-off device of the invention;

FIG. 3 is a side view of a flat object transfer device of the invention.

MORE DETAILED DESCRIPTION

A flat object unstacking device equipped with a transfer device of the invention and the operation of the transfer device will now be described with reference to FIGS. 1 to 3.

The unstacking device 10 comprises a moving belt 14 on which the mail is placed on edge, a feed magazine 13, a flat object holding device 16, a double pick separator 11 and a flat object transfer device 20 of the invention. The holding device 16 comprises a perforated belt 15 moving in front of a suction area 12.

When flat objects placed on the belt 14 reach the edge of the belt they are drawn into the feed magazine 13. The first flat object is attracted by the holding device 16 by the suction generated in the suction area via the perforations in the belt 15. The latter then draws the flat object along in a direction perpendicular to the direction of movement of the belt 14 towards the double pick separator 11. The separator comprises a suction area and its function is to retain a flat object that would otherwise be drawn along with a previous flat object by friction. The flat object 1, placed on edge on a substantially flat plane 31, is then drawn in a substantially vertical transfer plane P between two pinch rollers 21, 22 which face each other on opposite sides of the plane P. Each pinch roller 21, 22 is disposed between a respective pair of pulleywheels 23, 24 and 25, 35. The pulleywheels 23, 24 and 25, 35 are aligned parallel to the plane P so that the pulleywheels 23, 25 and 24, 35 face each other on opposite sides of the plane P and define a passage for a mail item in the plane P.

Two belts 27, 30 engage the roller 21 and the pulleywheels 23 and 24 on two levels and two belts 28, 29 engage the roller 22 and the pulleywheels 24 and 35 on two levels and are respectively face-to-face with the belts 27 and 30 on opposite sides of the plane P.

The pinch rollers 21, 22 preferably include a peripheral ring 21*a*, 22*a* of soft material which prevents the mail bouncing and contributes to stopping a mail item gripped between the two rollers almost immediately. The diameter of the pinch rollers is large enough to favor the entry of thick mail items between them. The diameter of the rollers 21 and 22 is greater than that of the pulleywheels 23, 24, 25, 35 so that the belts 28, 29 contact the respective belts 27, 30 only at a pinch point located between the axes of the two rollers and indicated by the point of intersection of the planes P and D in FIG. 2.

The transfer device 20 can be driven either via the pinch rollers 21, 22 or via the pulleywheels 23, 24, 25, 35. In a preferred embodiment of the invention the pinch rollers 21, 22 are free to move in a displacement plane D perpendicular to the mail item transfer plane. In a second embodiment of the invention one pinch roller is mobile and the other is fixed. The roller(s) mobile in the plane D retract(s) when a mail item enters the passage between the pulleywheels 24 and 35 and the tensioned belts 27 to 30 push the two rollers 21, 22 towards each other to grip the mail item. The transfer device 20 is preferably as close as possible to the holder 16 and has a transfer plane P which is preferably parallel to the holding plane. The double pick separator 11 is preferably between the two levels of the belts 28, 29 and on the upstream side of the pinch rollers 21, 22 (see FIG. 3).

The use of two belt levels on opposite sides of the double pick separator 11 has the advantage that it contributes to a resultant contact force in the immediate vicinity of the separator 11. A single belt level would bring about a movement that could cause creasing leading to a change in the inclination of the mail items.

The function of the pinch rollers 21, 22 is to immobilize each flat object pending authorization for its transfer to sorting buckets (not shown). The transfer authorization can be issued by control and processing means associated with the sorting means. To maintain an acceptable throughput the pinch rollers 21, 22 are immediately after the double pick separator 11.

A transfer device of the invention can therefore halt each processed mail item almost immediately regardless of its shape and thickness and therefore helps to reduce considerably the usual uneven halting of mail items.

Of course, the invention is not limited to the examples that have just been described and these examples can be modified in many ways without departing from the scope of the invention. For example, many ways of driving the pinch rollers and many methods of controlling the transfer device allowing for specific features of the sorting device on the downstream side of the unstacking device can be used. The number of belts can be other than two and the pulleywheels can be differently associated with the belts.

We claim:

1. A flat object transfer device for transferring flat objects from a device for unstacking the flat objects to a sorting device, said transfer device comprising:

gripping means for gripping a flat object initially located in a transfer plane, said gripping means comprising at least two pinch rollers at least one of which is mobile in a displacement plane perpendicular to said transfer plane and, for each roller, a plurality of drive belts stretched around the roller and at least two pulleywheels on opposite sides of the roller; and double pick separator means for retaining flat objects except for a flat object to be gripped by said gripping means, said separator means being disposed between two levels of said plurality of drive belts.

2. A flat object transfer device according to claim 1 further comprising drive means for driving one of said pinch rollers and said pullywheels.

3. A transfer device according to claim 2 further comprising control means for controlling said drive means so that the flat object gripped by said gripping means is temporarily immobilized before the flat object is transferred to the sorting device.

4. A transfer device according to claim 1 further comprising control means for controlling said gripping means so that the flat object gripped by said gripping means is temporarily immobilized before the flat object is transferred to the sorting device.

5. An unstacking device for unstacking flat objects and delivering the flat objects to a sorting device, said unstacking device comprising:

flat object feed means for feeding flat objects;

holding means for holding the flat objects fed by said feed means and moving the flat objects in a transfer direction;

a flat object transfer device comprising gripping means for gripping the flat objects held and moved by said holding means, said gripping means comprising at least two pinch rollers at least one of which is mobile in a displacement direction perpendicular to the transfer direction and, for each roller, a plurality of drive belts stretched around the roller and at least two pulleywheels on opposite sides of the roller; and double pick separator means for retaining the flat objects except for a flat object to be gripped by said gripping means, said separator means being disposed between two levels of said plurality of drive belts.

6. An unstacking device according to claim 5 wherein said double pick separator means is disposed upstream of said pinch rollers.

7. An unstacking device according to claim 6 wherein said double pick separator means is disposed adjacent said pullywheels.

8. An unstacking device according to claim 5 wherein said holding means and said gripping means are disposed so as to move the flat objects in substantially the same plane.

9. An unstacking device according to claim 5 further comprising control means for controlling said gripping means so that the flat object gripped by said gripping means is temporarily immobilized before the flat object is transferred to the sorting device.

* * * * *